US009115611B2

(12) United States Patent
Yamanaka et al.

(10) Patent No.: US 9,115,611 B2
(45) Date of Patent: Aug. 25, 2015

(54) VARIABLE VALVE OPERATING APPARATUS FOR INTERNAL COMBUSTION ENGINE

(71) Applicant: HITACHI AUTOMOTIVE SYSTEMS, LTD., Hitachinaka-shi, Ibaraki (JP)

(72) Inventors: Atsushi Yamanaka, Atsugi (JP); Ryo Tadokoro, Atsugi (JP); Hiroyuki Nemoto, Hitachi (JP); Isao Doi, Atsugi (JP)

(73) Assignee: HITACHI AUTOMOTIVE SYSTEMS, LTD., Hitachinaka-shi (JP)

( * ) Notice: Subject to any disclaimer, the term of this patent is extended or adjusted under 35 U.S.C. 154(b) by 0 days.

(21) Appl. No.: 14/293,545

(22) Filed: Jun. 2, 2014

(65) Prior Publication Data

US 2014/0373795 A1 Dec. 25, 2014

(30) Foreign Application Priority Data

Jun. 19, 2013 (JP) ..... 2013-128037

(51) Int. Cl.

| | |
|---|---|
| ***F01L 1/34*** | (2006.01) |
| ***F01L 1/344*** | (2006.01) |
| *F01L 13/00* | (2006.01) |
| *F01L 1/352* | (2006.01) |

(52) U.S. Cl.

CPC ..... *F01L 1/344* (2013.01); *F01L 1/352* (2013.01); *F01L 2013/103* (2013.01); *F01L 2820/032* (2013.01)

(58) Field of Classification Search

CPC ..... F01L 1/34406; F01L 1/34403; F01L 2013/103; F01L 2820/032; F01L 1/344; F01L 2001/3522; F01L 1/352

USPC ..... 123/90.11, 90.15, 90.17

See application file for complete search history.

(56) References Cited

U.S. PATENT DOCUMENTS

| | | | | |
|---|---|---|---|---|
| 8,544,432 | B2 | 10/2013 | Tadokoro et al. | |
| 8,752,515 | B2 * | 6/2014 | Yamanaka et al. | 123/90.17 |
| 8,973,545 | B2 * | 3/2015 | Kawada et al. | 123/90.17 |
| 8,978,608 | B2 * | 3/2015 | Tadokoro et al. | 123/90.17 |
| 8,985,075 | B2 * | 3/2015 | Tadokoro et al. | 123/90.17 |
| 2011/0265747 | A1 | 11/2011 | Tadokoro et al. | |
| 2014/0014052 | A1 | 1/2014 | Tadokoro et al. | |

FOREIGN PATENT DOCUMENTS

JP 2011-231700 A 11/2011

* cited by examiner

*Primary Examiner* — Thomas Denion
*Assistant Examiner* — Daniel Bernstein
(74) *Attorney, Agent, or Firm* — Foley & Lardner LLP

(57) ABSTRACT

A variable valve operating apparatus including an electric motor including a motor housing with a permanent magnet, and a speed reducing mechanism having a casing, the motor housing and the casing of the speed reducing mechanism being coupled to each other by a plurality of bolts, wherein the motor housing includes a convex portion formed in a portion of the motor housing which is opposed to one axial end of the permanent magnet, the convex portion having a threaded hole into which a tip end portion of each bolt is screwed, and a projection formed on an axial end surface of the convex portion in alignment with the threaded hole in an axial direction of the threaded hole, and wherein the axial end surface of the convex portion is located further spaced from the one axial end of the permanent magnet than the projection.

15 Claims, 8 Drawing Sheets

VARIABLE VALVE OPERATING APPARATUS FOR INTERNAL COMBUSTION ENGINE

BACKGROUND OF THE INVENTION

The present invention relates to a variable valve operating apparatus for an internal combustion engine which controls opening and closing timings of an engine valve, i.e., an intake valve and/or an exhaust valve of the internal combustion engine.

Recently, there has been proposed a valve timing control apparatus as a variable valve operating apparatus adapted to control opening and closing timings of an intake valve and/or an exhaust valve of an internal combustion engine by using a rotational driving force of an electric motor.

For instance, Japanese Patent Application Unexamined Publication No. 2011-231700 A recites a valve timing control apparatus including an electric motor and a speed reducing mechanism for reducing a rotational driving force of the electric motor. The electric motor is a DC motor with brushes which includes a cylindrical motor housing constituting a stator, permanent magnets disposed on an inner peripheral surface of the motor housing along a circumferential direction of the motor housing, and a core rotor disposed on an inner peripheral side of the permanent magnets, the core rotor being fixed on an outer periphery of a motor output shaft and equipped with coil windings.

Further, a partition wall made of a metal is disposed between the electric motor and the speed reducing mechanism to separate the electric motor and the speed reducing mechanism from each other. The partition wall has an annular convex portion on an outer peripheral side thereof which is formed integrally with the partition wall. The annular convex portion has a threaded hole into which a tip end portion of a bolt is screwed to couple the motor housing and a casing of the speed reducing mechanism to each other in an axial direction thereof.

Further, the partition wall is arranged as close to the electric motor as possible in an axial direction of the electric motor so that the valve timing control apparatus is reduced in axial length thereof to thereby be downsized.

SUMMARY OF THE INVENTION

However, in the above conventional art, when the whole partition wall including the annular projection is arranged excessively close to the electric motor, that is, excessively close to one axial end of each permanent magnet, there is a fear that lines of magnetic force (magnetic flux) formed between the motor housing and the permanent magnets are leaked from a whole outer periphery of the respective permanent magnets to the partition wall so that deterioration of magnetic efficiency of the permanent magnets is caused to thereby fail to obtain a sufficient output torque of the electric motor.

It is an object of the present invention to provide a variable valve operating apparatus for an internal combustion engine which can suppress leakage of a magnetic flux to thereby ensure an output torque of an electric motor while achieving reduction in size of the variable valve operating apparatus.

In a first aspect of the present invention, there is provided a variable valve operating apparatus for an internal combustion engine, including:

an electric motor comprising a motor housing having an accommodating space therein and being made of a magnetic material, at least one permanent magnet disposed on an inner peripheral surface of the motor housing, the permanent magnet having a plurality of magnetic poles along a circumferential direction thereof, a rotor disposed on an inner peripheral side of the permanent magnet so as to be rotatable relative to the permanent magnet, the rotor having a coil wound thereon to form a magnetic flux in a circumferential direction of the rotor upon being energized, and a brush and a commutator which cooperate with each other to carry out changeover between energization and non-energization of the coil; and a speed reducing mechanism configured to reduce a speed of rotation of the electric motor, the speed reducing mechanism including a casing, wherein the motor housing and the casing of the speed reducing mechanism are coupled to each other by means of a plurality of bolts inserted from a side of the casing of the speed reducing mechanism into the motor housing, wherein the motor housing includes a convex portion formed in a portion of the motor housing which is opposed to one axial end of the permanent magnet, the convex portion having a threaded hole into which a tip end portion of each of the plurality of bolts is screwed, respectively, and a projection formed on an axial end surface of the convex portion in alignment with the threaded hole in an axial direction of the threaded hole, and wherein the axial end surface of the convex portion is located further spaced from the one axial end of the permanent magnet than the projection.

In a second aspect of the present invention, there is provided the variable valve operating apparatus according to the first aspect of the present invention, wherein the projection is opposed to the one axial end of the permanent magnet with a space.

In a third aspect of the present invention, there is provided the variable valve operating apparatus according to the second aspect of the present invention, wherein the space between the projection and the one axial end of the permanent magnet has an axial length larger than a radial length of an air gap between an outer peripheral surface of the rotor and an inner peripheral surface of the permanent magnet.

In a fourth aspect of the present invention, there is provided the variable valve operating apparatus according to the first aspect of the present invention, wherein the projection has an outer surface having a rounded convex shape.

In a fifth aspect of the present invention, there is provided the variable valve operating apparatus according to the first aspect of the present invention, wherein the projection has a closed end in an axial direction thereof such that the tip end portion of each of the plurality of bolts is prevented from penetrating the projection.

In a sixth aspect of the present invention, there is provided the variable valve operating apparatus according to the first aspect of the present invention, wherein the motor housing further includes a partition wall disposed on one axial end portion of the motor housing which is located on a side of the speed reducing mechanism, the partition wall being integrally formed with the projection, the partition wall serving to separate the electric motor and the speed reducing mechanism from each other.

In a seventh aspect of the present invention, there is provided the variable valve operating apparatus according to the sixth aspect of the present invention, wherein the partition wall includes a concave portion recessed toward the speed reducing mechanism, a part of the coil being located close to the concave portion of the partition wall.

In an eighth aspect of the present invention, there is provided the variable valve operating apparatus according to the seventh aspect of the present invention, wherein the coil is arranged in such a state that the part of the coil is fitted into the concave portion of the partition wall.

In a ninth aspect of the present invention, there is provided the variable valve operating apparatus according to the eighth aspect of the present invention, wherein the partition wall has a shaft insertion hole at a central portion thereof which receives a motor output shaft through which rotation of the rotor is transmitted to the speed reducing mechanism, and a seal member is disposed between the partition wall and the motor output shaft, the seal member serving to prevent a lubricating oil for lubricating parts of the speed reducing mechanism from flowing into the motor housing.

In a tenth aspect of the present invention, there is provided the variable valve operating apparatus according to the first aspect of the present invention, wherein the variable valve operating apparatus is used for a rotational phase adjusting mechanism configured to adjust a valve timing of an engine valve by transmitting a reduced speed of rotation of the electric motor which is reduced by the speed reducing mechanism to a camshaft, the variable valve operating apparatus further comprising a slip ring and a second brush moveable while being contacted with the slip ring, the electric motor being energized through the slip ring and the second brush.

In an eleventh aspect of the present invention, there is provided a variable valve operating apparatus for an internal combustion engine, including:

an electric motor including a motor housing having an accommodating space therein and being made of a magnetic material, at least one permanent magnet disposed on an inner peripheral surface of the motor housing, the permanent magnet having a plurality of magnetic poles along a circumferential direction thereof, a rotor disposed on an inner peripheral side of the permanent magnet so as to be rotatable relative to the permanent magnet, the rotor having a coil wound thereon to form a magnetic flux in a circumferential direction of the rotor upon being energized, and a brush and a commutator which cooperate with each other to carry out changeover between energization and non-energization of the coil; and a speed reducing mechanism configured to reduce a speed of rotation of the electric motor, the speed reducing mechanism including a casing, wherein the motor housing and the casing of the speed reducing mechanism are coupled to each other by means of a plurality of fastening members inserted from a side of the casing of the speed reducing mechanism into the motor housing, wherein the motor housing includes a plurality of fastening member insertion portions into which the plurality of fastening members are inserted, respectively, the plurality of fastening member insertion portions being formed along a circumferential direction of the motor housing and opposed to one axial end of the permanent magnet, and wherein low permeable portions each having a permeability lower than a permeability of each of the plurality of fastening member insertion portions are provided on a side of an axial end of each of the plurality of fastening member insertion portions.

In a twelfth aspect of the present invention, there is provided the variable valve operating apparatus according to the eleventh aspect of the present invention, wherein each of the low permeable portions is an air space between the axial end of each of the plurality of fastening member insertion portions and the one axial end of the permanent magnet.

In a thirteenth aspect of the present invention, there is provided the variable valve operating apparatus according to the eleventh aspect of the present invention, wherein each of the low permeable portions is a non-magnetic member.

In a fourteenth aspect of the present invention, there is provided the variable valve operating apparatus according to the thirteenth aspect of the present invention, wherein the non-magnetic member is disposed on an axial end surface of each of the plurality of fastening member insertion portions.

In a fifteenth aspect of the present invention, there is provided a variable valve operating apparatus for an internal combustion engine, including:

an electric motor including a motor housing having an accommodating space therein and being made of a magnetic material, a first magnetic flux forming portion disposed on an inner peripheral surface of the motor housing, the first magnetic flux forming portion having a plurality of magnetic poles along a circumferential direction thereof, a second magnetic flux forming portion disposed on an inner peripheral side of the first magnetic flux forming portion so as to be rotatable relative to the permanent magnet, the second magnetic flux forming portion being configured to form a magnetic flux in a circumferential direction thereof upon being energized; and a speed reducing mechanism configured to reduce a speed of rotation of the electric motor, the speed reducing mechanism including a casing, wherein the motor housing and the casing of the speed reducing mechanism are coupled to each other by means of a plurality of fastening members inserted from a side of the casing of the speed reducing mechanism into the motor housing, wherein the motor housing includes a plurality of fastening member insertion portions into which the plurality of fastening members are inserted, respectively, the plurality of fastening member insertion portions being formed along a circumferential direction of the motor housing and opposed to one axial end of the first magnetic flux forming portion, and wherein an air space or a non-magnetic member is provided at least between an axial end surface of each of the plurality of fastening member insertion portions and the one axial end of the first magnetic flux forming portion.

According to the present invention, there is provided a variable valve operating apparatus in which an axial length of the step portion is reduced so that the variable valve operating apparatus can be downsized while suppressing leakage of a magnetic flux to the step portion to thereby ensure an output torque of the electric motor.

Other objects and features of this invention will become understood from the following description with reference to the accompanying drawings.

DETAILED DESCRIPTION OF THE INVENTION

With reference to the accompanying drawings, first to fourth embodiments of a variable valve operating apparatus for an internal combustion engine according to the present invention are explained.

First Embodiment

Figure 1:
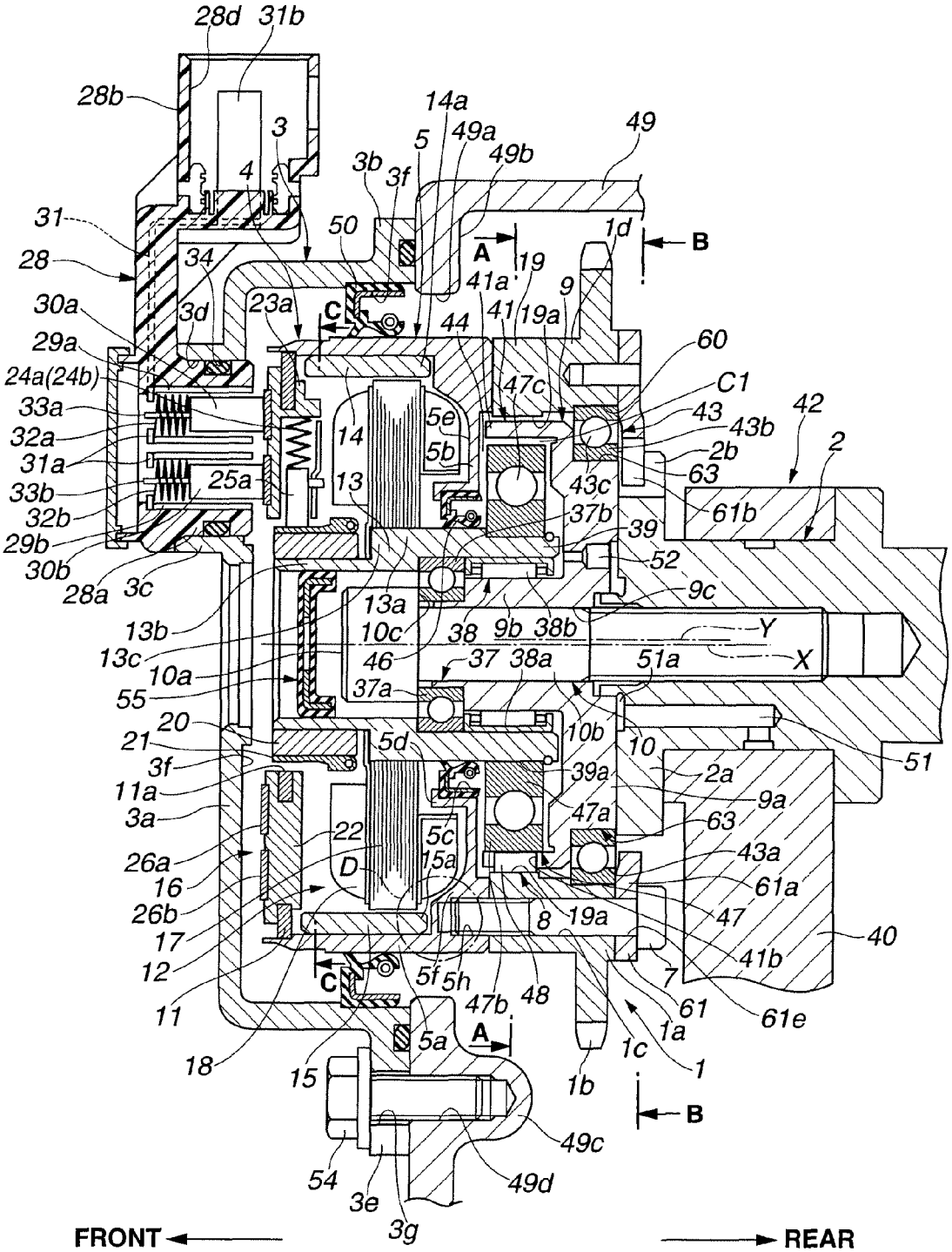
FIG. 1 is a vertical cross-section of a variable valve operating apparatus according to a first embodiment of the present invention.
Figure 2:
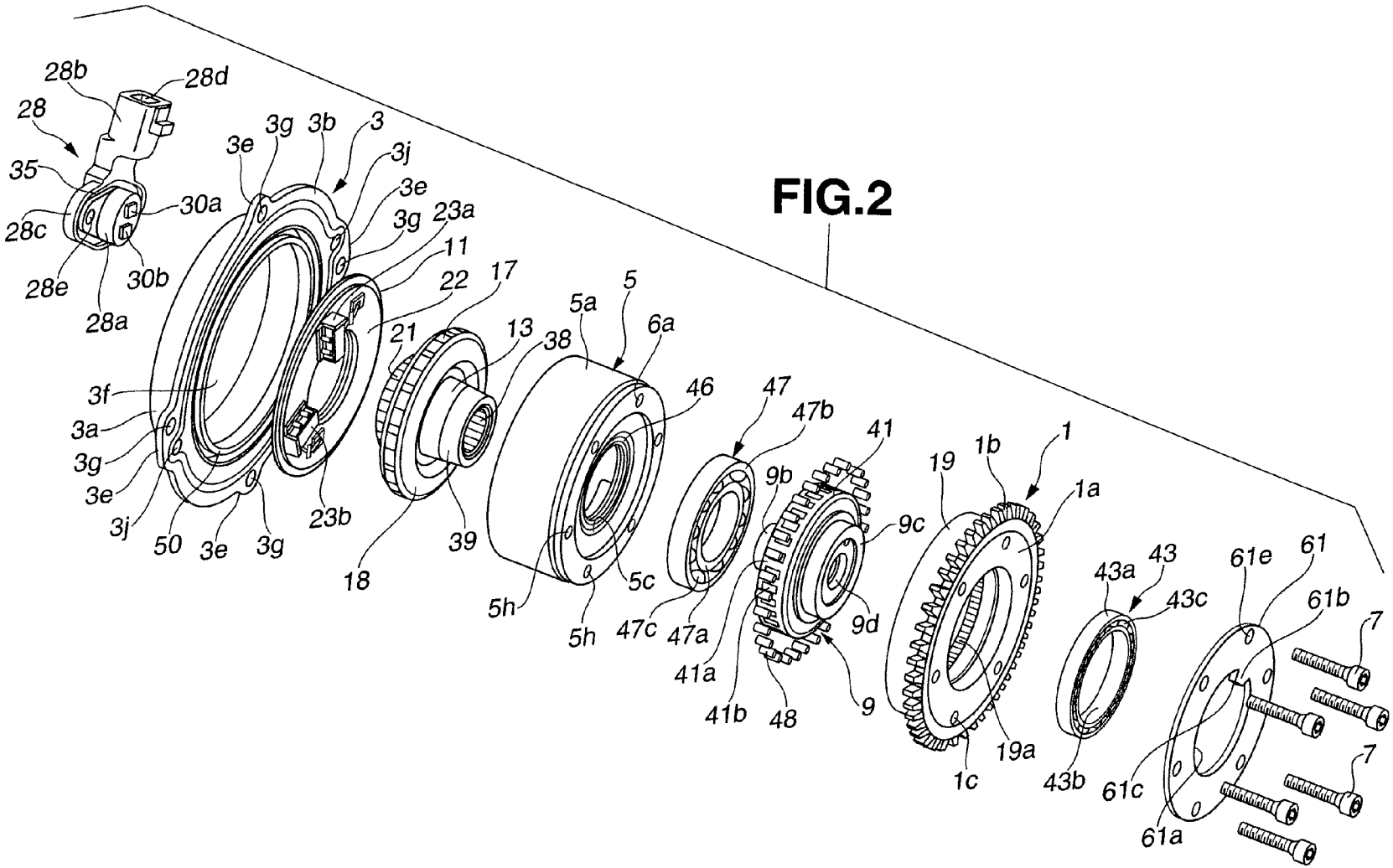
FIG. 2 is an exploded perspective view of an essential part of the variable valve operating apparatus according to the first embodiment of the present invention.

As shown in FIG. 1 and FIG. 2, a variable valve operating apparatus according to a first embodiment includes timing sprocket 1 serving as a drive rotation member that is rotated by a crankshaft of an internal combustion engine, camshaft 2 rotatably supported on cylinder head 40 through bearing 42 and being rotated by a rotational force transmitted from timing sprocket 1, and rotational phase adjusting mechanism 4 covered with chain cover 49 and cover member 3 fixed to chain cover 49. Rotational phase adjusting mechanism 4 is configured to adjust a relative rotational phase between timing sprocket 1 and camshaft 2 in accordance with an engine operating condition.

Timing sprocket 1 includes ring-shaped sprocket body 1*a* made of an iron-based metal material and formed with a stepwise inner peripheral surface. Gear wheel 1*b* is integrally formed with an outer periphery of sprocket body 1*a*, and receives the rotational force from the crankshaft through a timing chain, not shown. Internal gear member 19 is disposed on a front end side of sprocket body 1*a* and integrally formed with sprocket body 1*a*.

Large-diameter ball bearing 43 is disposed between sprocket body 1*a* and follower member (i.e., follower rotation member) 9 disposed on a front end portion of camshaft 2. Timing sprocket 1 and camshaft 2 are relatively rotatably supported by large-diameter ball bearing 43.

Large-diameter ball bearing 43 includes outer race 43*a*, inner race 43*b* and balls 43*c* disposed between outer race 43*a* and inner race 43*b*. Outer race 43*a* is fixed to an inner peripheral side of sprocket body 1*a*. Inner race 43*b* is fixed to an outer peripheral side of follower member 9.

Sprocket body 1*a* has on an inner periphery thereof outer race fixing portion 60 that is opened toward a side of camshaft 2 and formed as an annular cutout. Outer race fixing portion 60 is formed into a step shape and includes an annular inner peripheral surface extending in an axial direction of camshaft 2 and a first fixing step surface extending in a radial direction of camshaft 2 on a side opposite to the open side of outer race fixing portion 60. Outer race 43*a* of large-diameter ball bearing 43 is press-fitted onto the annular inner peripheral surface of outer race fixing portion 60 in an axial direction of ball bearing 43. One axial end surface of outer race 43*a* abuts on the first fixing step surface, thereby carrying out positioning of outer race 43*a* in one axial direction of outer race 43*a*.

Internal gear member 19 is disposed on a front end portion of sprocket body 1*a* of timing sprocket 1 on an inner peripheral side thereof, and integrally formed with sprocket body 1*a*. Internal gear member 19 is formed into a cylindrical shape that has a relatively large wall thickness and extends toward electric motor 12 of rotational phase adjusting mechanism 4. Internal gear member 19 has a plurality of wave-formed internal teeth 19*a* on an inner periphery thereof.

Annular retaining plate 61 is disposed on a rear end portion of sprocket body 1*a* which is located on a side opposite to internal gear member 19. Retaining plate 61 is formed of a metal plate. As shown in FIG. 1, retaining plate 61 has an outer diameter substantially the same as that of sprocket body 1*a*. Inner peripheral portion 61*a* of retaining plate 61 has an inner diameter smaller than that of outer race 43*a* of large-diameter ball bearing 43. Inner peripheral portion 61*a* of retaining plate 61 supports the other axial end surface of outer race 43*a* with a slight pressing force and serves for positioning of outer race 43*a* in an axial direction thereof.

Figure 7:
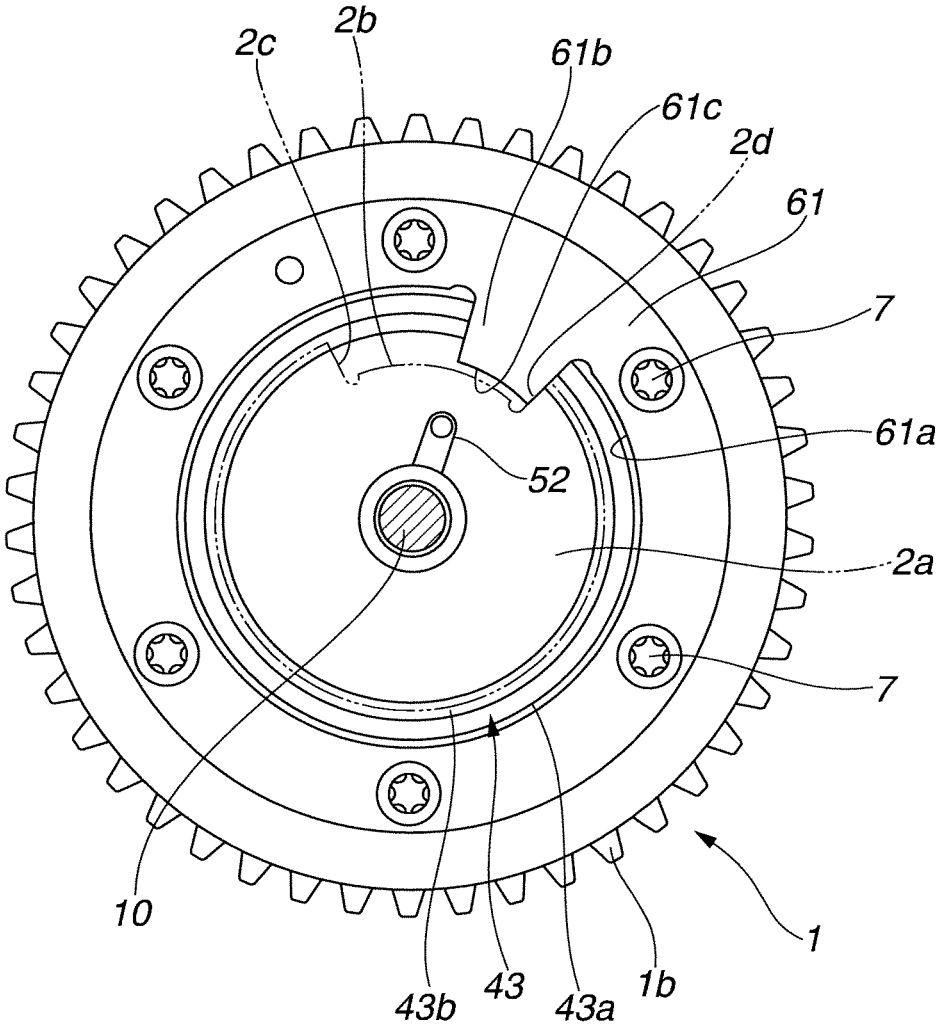
FIG. 7 is a cross-section of the variable valve operating apparatus according to the first embodiment of the present invention, taken along line B-B as shown in FIG. 1.

Stopper projection 61*b* is disposed in a predetermined position on an inner peripheral edge of inner peripheral portion 61*a* of retaining plate 61, and integrally formed with inner peripheral portion 61*a*. Stopper projection 61*b* projects in a radially inward direction of retaining plate 61, that is, toward a central axis of retaining plate 61. As shown in FIG. 1 and FIG. 7, stopper projection 61*b* is formed into a generally sector-shape, and has arcuate tip end edge 61*c* formed along an arcuate inner peripheral surface of stopper engaging groove portion 2*b* as explained later. Retaining plate 61 has six bolt insertion holes 61*e* on an outer peripheral portion thereof. Bolt insertion holes 61*d* are formed at equal intervals in a circumferential direction of retaining plate 61, and extend through retaining plate 61.

Sprocket body 1*a* (i.e., internal gear member 19) has six bolt insertion holes 1*c* on an outer peripheral portion thereof. Bolt insertion holes 1*c* are formed at equal intervals in a circumferential direction of sprocket body 1*a*, and extend through sprocket body 1*a*.

Further, sprocket body 1*a* and internal gear member 19 cooperate to each other to form a casing of roller speed reducing mechanism 8 as explainer later.

Further, sprocket body 1*a*, internal gear member 19 and retaining plate 61 have substantially the same outer diameter.

As shown in FIG. 1, chain cover 49 is fixedly disposed on a front end side of cylinder head 40 and a cylinder block along an upward-downward direction so as to cover a chain (not shown) wound on timing sprocket 1. chain cover 49 has opening 49*a* formed in a position corresponding to rotational phase adjusting mechanism 4. Four boss portions 49*c* are formed on annular wall 49*b* of chain cover 49 which defines opening 49*a*, in a spaced relation to each other in a circumferential direction of annular wall 49*b*. Four boss portions 49*c* are formed integrally with annular wall 49*b*. Threaded hole 49*d* extends from a front end surface of annular wall 49*b* into each of boss portions 49*c*.

Cover member 3 is made of an aluminum alloy material and formed into a cup shape as shown in FIG. 1 and FIG. 2. Cover member 3 includes swelled cover body 3*a* on a front end side thereof, and annular mount flange 3*b* formed integrally with an outer peripheral edge of swelled cover body 3*a*. Swelled cover body 3*a* is formed so as to cover a front end portion of cylindrical motor housing 5 of electric motor 12. Cylindrical wall 3*c* is formed on an outer peripheral side of swelled cover body 3*a*, and extends along an axial direction of cover member 3. Cylindrical wall 3*c* defines retaining hole 3*d* in which brush retainer 28 is retained.

Mount flange 3*b* has four projecting tabs 3*e* formed on an outer periphery of mount flange 3*b* at substantially same intervals. Projecting tabs 3*e* have bolt insertion holes 3*g* extending through projecting tabs 3*e*, respectively. Bolt 54 is inserted into each bolt insertion hole 3*g* and each threaded hole 49*d* of chain cover 49, thereby fixing cover member 3 to chain cover 64.

As shown in FIG. 1, swelled cover body 3*a* has inner peripheral step surface 3*f* on a rear side thereof which is opposed to an outer peripheral surface of motor housing 5. Large-diameter oil seal 50 is disposed between the inner peripheral step surface of swelled cover body 3*a* and the outer peripheral surface of motor housing 5. Large-diameter oil seal 50 has a generally C-shape in cross-section, and includes a synthetic rubber base and a core plate embedded in the synthetic rubber base. Large-diameter oil seal 50 has an annular base portion on an outer peripheral side thereof which is fitted to inner peripheral step surface 3*f* of swelled cover body 3*a* of cover member 3.

Motor housing 5 includes housing body 5*a* and sealing plate 11 that seals a front end opening of housing body 5*a*. Housing body 5*a* is made of an iron-based metal material, and formed into a cylindrical shape having an accommodating space by pressing. Sealing plate 11 is made of a non-magnetic synthetic resin material.

Housing body 5*a* has ring-shaped partition wall 5*b* on a rear side of housing body 5*a*. Partition wall 5*b* is located on an inner peripheral side of housing body 5*a*, and formed integrally with housing body 5*a*. Partition wall 5*b* serves to separate speed reducing mechanism 8 and electric motor 12 from each other. Large-diameter shaft insertion hole 5*c* extends through a substantially central portion of partition wall 5*b*, into which eccentric shaft portion 39 is inserted. Cylindrical extension wall 5*d* extends from a peripheral edge of shaft insertion hole 5*c* toward cover member 3. Partition wall 5*b* has front end surface 5*e* defining a concave portion. The concave portion is recessed toward speed reducing mechanism 8 such that the wall thickness of partition wall 5*b* is gradually reduced toward a radial inside of partition wall 5*b*.

Camshaft 2 has two drive cams (not shown) on an outer peripheral surface thereof which are provided each cylinder and operative to open intake valves (not shown). Further, camshaft 2 has flange portion 2*a* on a front end portion thereof which is integrally formed with camshaft 2. Each of the drive cams has a generally oval shape, and is operated to open the intake valves against a spring force of valve springs.

As shown in FIG. 1, flange portion 2*a* has an outer diameter slightly larger than that of fixed end portion 9*a* of follower member 9. An outer peripheral portion of a front end surface of flange portion 2*a* is contacted with an axial end surface (i.e., a rear end surface) of inner race 43*b* of large-diameter ball bearing 43. Camshaft 2 is coupled with follower member 9 by cam bolt 10 in such a state that the front end surface of flange portion 2*a* is in contact with follower member 9 in an axial direction of camshaft 2.

As shown in FIG. 7, flange portion 2*a* has stopper engaging groove portion 2*b* on an outer periphery thereof. Stopper engaging groove portion 2*b* extends along a circumferential direction of flange portion 2*a*, and is engaged with stopper projection 61*b* of retaining plate 61. Stopper engaging groove portion 2*b* has a generally sector shape having a predetermined length along the circumferential direction of flange portion 2*a*. Stopper projection 61*b* can be moved within a region of the length of stopper engaging groove portion 2*b* until both side surfaces of stopper projection 61*b* abuts against opposed surfaces 2*c*, 2*d* of stopper engaging groove portion 2*b* in the circumferential direction. Owing to abutment contact with opposed surfaces 2*c*, 2*d* of stopper engaging groove portion 2*b*, stopper projection 61*b* can serve to restrain camshaft 2 from further rotating relative to timing sprocket 1 toward a maximum phase-advance side and a maximum phase-retard side.

Stopper projection 61*b* is bent to become closer to the side of the drive cams of camshaft 2 than inner peripheral portion 61*a* of retaining plate 61, so that stopper projection 61*b* is out of contact with fixed end portion 9*a* of follower member 9. With this construction, it is possible to suppress interference between stopper projection 61*b* and fixed end portion 9*a*.

Stopper projection 61*b* and stopper engaging groove portion 2*b* constitute a stop mechanism.

As shown in FIG. 1, cam bolt 10 includes head portion 10*a* and shaft portion 10*b* connected with head portion 10*a*. Head portion 10*a* has end surface 10*c* on a side of shaft portion 10*b* which is contacted with an inner race of small-diameter ball bearing 37 in an axial direction of cam bolt 10. Shaft portion 10*b* has a male screw portion on an outer periphery of a tip end portion thereof. The male screw portion is screwed into a threaded hole extending inwardly from the front end portion of camshaft 2 in the axial direction of camshaft 2.

Follower member 9 is integrally formed of an iron-based metal material. As shown in FIG. 1, follower member 9 includes ring-shaped fixed end portion 9*a* disposed on the side of camshaft 2, cylindrical portion 9*b* concentrically projecting forwardly from an inner peripheral side of a front end surface of fixed end portion 9*a*, and comb-shaped cylindrical cage 41 integrally formed on an outer periphery of fixed end portion 9*a*. Cage 41 retains a plurality of rollers 48 as explained later.

Follower member 9 has insertion hole 9*c* at a central portion thereof which extends through fixed end portion 9*a* and cylindrical portion 9*b* in an axial direction of follower member 9. Shaft portion 10*b* of cam bolt 10 is inserted into insertion hole 9*c*. A rear end surface of fixed end portion 9*a* is contacted with a front end surface of flange portion 2*a* of camshaft 2. Fixed end portion 9*a* is press-contacted with flange portion 2*a* and fixed thereto in the axial direction by an axial force of cam bolt 10. As shown in FIG. 1, cylindrical portion 9*b* has needle bearing 38 on an outer periphery thereof.

As shown in FIG. 1 and FIG. 2, cage 41 has a generally annular shape having an L-shaped cross-section. Cage 41 includes a bottom wall extending from a front side of the outer periphery of fixed end portion 9*a* in a radially outward direction of follower member 9, and peripheral side wall 41*a* forwardly extending from an outer periphery of the bottom wall in parallel with cylindrical portion 9*b*. Side wall 41*a* of cage 41 extends toward partition wall 5*b* of housing body 5*a* through annular clearance 44. A plurality of roller retaining holes 41*b* are formed in side wall 41*a* at equal intervals therebetween in a circumferential direction of side wall 41*a*. Roller retaining holes 41*b* each have a generally elongated rectangular shape, in which a plurality of rollers 48 are rollably retained. A total number of roller retaining holes 41*b* (i.e., the number of rollers 48) is less by one than that of internal teeth 19*a* of internal gear member 19.

Disposed between the outer periphery of fixed end portion 9*a* and the bottom wall of cage 41 is inner race fixing portion 63 to which inner race 43*b* of large-diameter ball bearing 43 is fixed.

Inner race fixing portion 63 is formed into a stepped cutout, and opposed to outer race fixing portion 60 in a radial direction of follower member 9. Inner race 43*b* of large-diameter ball bearing 43 is press-fitted onto an outer peripheral surface of inner race fixing portion 63 in the axial direction of follower member 9. A front end surface of inner race 43*b* is contacted with a step surface of inner race fixing portion 63 which extends from a front end of the outer peripheral surface of inner race fixing portion 63 in the radial direction of follower member 9. Inner race 43*b* is thus held in place in an axial direction of large-diameter ball bearing 43.

Rotational phase adjusting mechanism 4 includes electric motor 12 as an actuator which is disposed substantially coaxially with camshaft 2 on a front side of camshaft 2, and roller speed reducing mechanism 8 that serves to reduce rotational speed of electric motor 12 and transmit the reduced rotational speed to camshaft 2.

Electric motor 12 is a brush-equipped DC motor. As shown in FIG. 1 and FIG. 2, electric motor 12 includes housing 5 that makes a unitary rotation with timing sprocket 1. Housing 5 includes housing body 5*a* as a magnetic member. Electric motor 12 also includes motor output shaft 13 rotatably disposed within housing body 5*a*, a pair of semi-arcuate permanent magnets 14, 15 as a stator which are fixed on an inner peripheral surface of housing body 5*a*, and stationary unit 16 fixed to sealing plate 11. Permanent magnets 14, 15 are made of a ferrite material and serve as a first magnetic flux forming portion.

Motor output shaft 13 is formed into a stepped cylindrical shape, and serves as an armature. Motor output shaft 13 includes large-diameter portion 13*a* disposed on the side of camshaft 2, small-diameter portion 13*b* disposed on the side of brush retainer 28, and step portion 13*c* disposed in a substantially middle position in an axial direction of motor output shaft 13, through which large-diameter portion 13*a* and small-diameter portion 13*b* are connected with each other. Core rotor 17 as a second magnetic flux forming portion is fixed on an outer periphery of large-diameter portion 13*a*. Eccentric shaft portion 39 is integrally formed with a rear end portion of large-diameter portion 13*a*.

On the other hand, ring member 20 is press-fitted onto an outer periphery of small-diameter portion 13*b* of motor output shaft 13, and fixed thereto. Commutator 21 is press-fitted onto an outer peripheral surface of ring member 20. Ring member 20 is contacted with an axial end surface of step portion 13*c* of motor output shaft 13 and thus held in place in an axial direction thereof. Ring member 20 has an outer diameter substantially same as that of large-diameter portion 13*a*, and an axial length slightly smaller than that of small-diameter portion 13*b*.

Cap 55 is press-fitted and fixed into small-diameter portion 13*b* of motor output shaft 13. Cap 55 serves to suppress leakage of lubricating oil that is supplied to motor output shaft 13 and eccentric shaft portion 39 and lubricates bearings 37 and 38.

Core rotor 17 is formed of a magnetic member having a plurality magnetic poles. Core rotor 17 has on an outer peripheral portion thereof a bobbin portion having slots in which coil windings of coil 18 are disposed.

Commutator 21 is made of an electrically conductive material, and formed into an annular shape. Commutator 21 is constituted of a plurality of segments. The number of the segments is the same as that of the magnetic poles of core rotor 17. Terminals drawn from the coil windings of coil 18 are electrically connected to the segments, respectively. That is, a tip end of each of the terminals of the coil windings of coil 18 is hooked on a folded portion formed on the inner peripheral side of commutator 21, so that electrical connection between coil 18 and commutator 21 is established.

Permanent magnets 14, 15 cooperate with each other to form a cylindrical shape, and have a plurality of magnetic poles in a circumferential direction thereof. Permanent magnets 14, 15 are located in a position forwardly offset from core rotor 17 in an axial direction thereof. Specifically, as shown in FIG. 1, a center of respective permanent magnets 14, 15 in the axial direction thereof is located forwardly (i.e., toward the side of stationary unit 16) offset from a center of core rotor 17 in the axial direction thereof by a predetermined distance.

With the offset arrangement, front end portions of permanent magnets 14, 15 are overlapped with commutator 21, first brushes 25*a*, 25*b* of stationary unit 16 in a radial direction of permanent magnets 14, 15.

Figure 5:
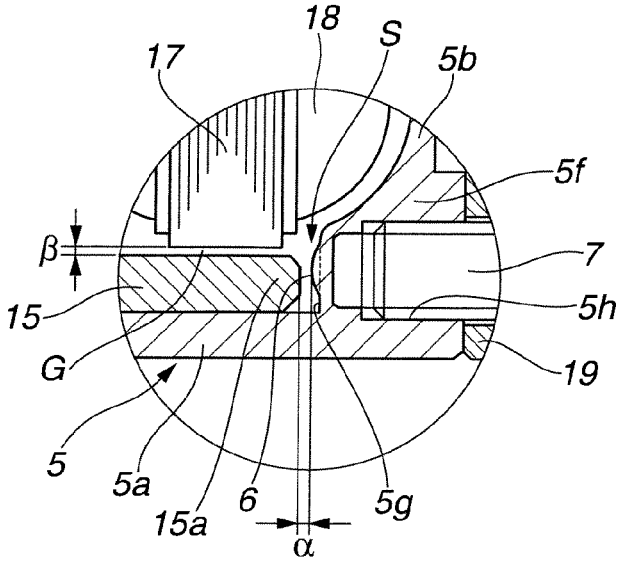
FIG. 5 is an exploded view of a circled portion D as shown in FIG. 1.

As shown in FIG. 5, annular air gap G for ensuring magnetic flux density is formed between inner peripheral surfaces of permanent magnets 14, 15 and an outer peripheral surface of core rotor 17. Radial length β of air gap G is set to a small value, for instance, about 0.3-0.5 mm.

Figure 8:
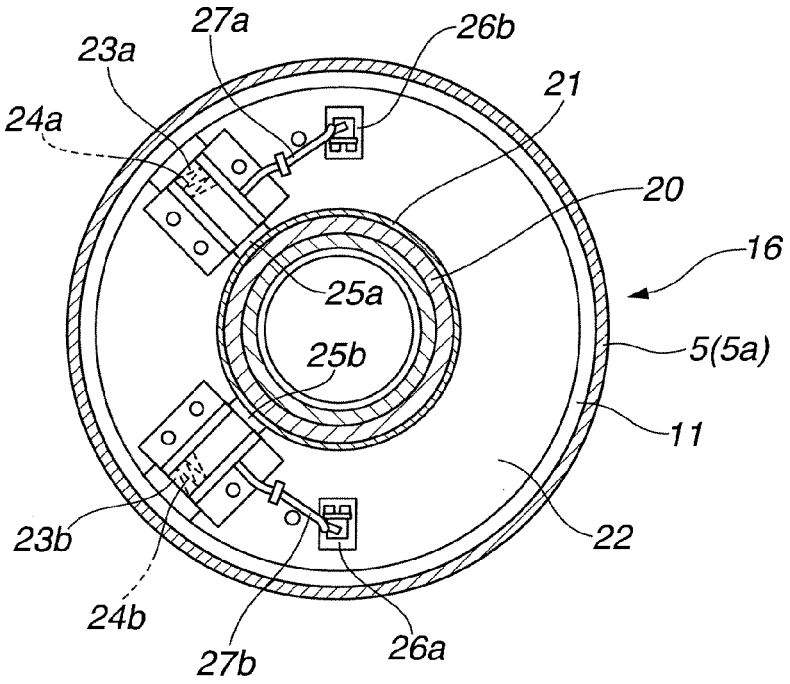
FIG. 8 is a cross-section of the variable valve operating apparatus according to the first embodiment of the present invention, taken along line C-C as shown in FIG. 1.

As shown in FIG. 8, stationary unit 16 includes ring-shaped resin plate 22 integrally formed on an inner peripheral side of sealing plate 11, a pair of resin holders 23*a*, 23*b* disposed on a rear surface of resin plate 22, a pair of first brushes 25*a*, 25*b* slidably disposed in respective resin holders 23*a*, 23*b* in a radial direction of resin plate 22, inner and outer annular slip rings 26*a*, 26*b* concentrically disposed on front end surfaces of resin holders 23*a*, 23*b*, and pigtail harnesses 27*a*, 27*b* that electrically connect first brushes 25*a*, 25*b* and slip rings 26*a*, 26*b* with each other. First brushes 25*a*, 25*b* are biased by coil springs 24*a*, 24*b* such that tip end surfaces thereof are resiliently contacted with an outer peripheral surface of commutator 21 in the radial direction of resin plate 22. Slip rings 26*a*, 26*b* are respectively embedded in and fixed to the front end surfaces of resin holders 23*a*, 23*b* such that front surfaces thereof are exposed outside.

Sealing plate 11 is fixed to a recessed step portion formed in an inner periphery of a front end portion of motor housing 5 by caulking. Shaft insertion hole 11*a* extends through a central portion of sealing plate 11, through which one end portion of motor output shaft 13 is inserted.

Brush retainer 28 is fixed to cover body 3*a*. Brush retainer 28 is integrally molded from a synthetic resin material. As shown in FIG. 1, brush retainer 28 has a generally L-shape in side view. Brush retainer 28 includes generally cylindrical brush retaining portion 28*a* inserted into retaining hole 3*d* of cover body 3*a*, connector portion 28*b* disposed on an upper end of brush retaining portion 28*a*, a pair of bracket portions 28*c*, 28*c* projecting on both sides of brush retaining portion 28*a* and fixed to cover body 3*a*, and a pair of terminals 31, 31 substantially embedded in brush retainer 28.

Terminals 31, 31 are formed into a crank shape vertically extending in parallel to each other. Each of terminals 31, 31 has one end portion (i.e., a lower end portion) 31*a* exposed to the side of a bottom of brush retaining portion 28*a*, and the other end portion (i.e., an upper end portion) 31*b* projecting into female engaging groove 28*d* of connector portion 28*b*. The other end portion 31*b* is electrically connected to a battery power supply through a male terminal (not shown).

Brush retaining portion 28*a* extends in a substantially horizontal direction (i.e. in an axial direction thereof). Brush retaining portion 28*a* includes sleeve-shaped slide portions 29*a*, 29*b* fixed into cylindrical through-holes that are formed in upper and lower positions in brush retaining portion 28*a*. Slide portions 29*a*, 29*b* respectively retain second brushes 30*a*, 30*b* so as to be slidable in an axial direction of the cylindrical through-holes.

Each of second brushes 30*a*, 30*b* has a generally rectangular prism shape. Second brushes 30*a*, 30*b* are respectively biased toward slip rings 26*a*, 26*b* in an axial direction thereof by second coil springs 32*a*, 32*b* such that rear end surfaces of second brushes 30*a*, 30*b* are contacted with slip rings 26*a*, 26*b*, respectively. Each of second coil springs 32*a*, 32*b* is installed between a front end surface of each of second brushes 30*a*, 30*b* and the one end portion 31*a* of each of terminals 31, 31 exposed to a bottom of each of the cylindrical through-holes.

A rear end portion of each of second brushes 30*a*, 30*b* and the one end portion 31*a* of each of terminals 31, 31 are electrically connected with each other through resilient pigtail harness 33*a* or 33*b* welded thereto. Each of pigtail harnesses 33*a*, 33*b* has such a predetermined length that each of second brushes 30*a*, 30*b* can be prevented from falling off from each of slide portions 29*a*, 29*b* when being urged to advance to a maximum slide position by each of coil springs 32*a*, 32*b*.

Annular seal member 34 is fitted into an annular engaging groove formed on an outer periphery of brush retaining portion 28*a*. When brush retaining portion 28*a* is inserted into retaining hole 3*d* of cylindrical wall 3*c* of cover body 3*a*, seal member 34 is elastically pressed onto an inner peripheral surface of cylindrical wall 3*c* and seals an inside of brush retaining portion 28*a*.

The other end portion 31*b* of each of terminals 31, 31 is exposed to engaging groove 28*d* of connector portion 28*b*, and electrically connected to a control unit (not shown) through a male terminal (not shown) which is to be inserted into engaging groove 28*d*.

As shown in FIG. 2, bracket portions 28*c*, 28*c* each have a generally triangular shape. Bolt insertion holes 28*e*, 28*e* extend through bracket portions 28*c*, 28*c*, respectively, into which bolts (not shown) are inserted to fix brush retainer 28 to cover body 3*a*.

Motor output shaft 13 and eccentric shaft portion 39 are rotatably supported by small-diameter ball bearing 37 disposed on shaft portion 10*b* of cam bolt 10, and needle bearing 38 disposed on the rear side of small-diameter ball bearing 37. Small-diameter ball bearing 37 is disposed on an outer peripheral surface of shaft portion 10*b* on the side of head portion 10*a* of cam bolt 10. Needle bearing 38 is disposed on an outer peripheral surface of cylindrical portion 9*b* of follower member 9.

Small-diameter ball bearing 37 includes inner race 37*a*, outer race 37*b* and a plurality of balls 37*c* disposed between inner race 37*a* and outer race 37*b*. Inner race 37*a* of small-diameter ball bearing 37 is fixed in a state interposed between a stepped front end surface of cylindrical portion 9*b* of follower member 9 and end surface 10*c* of head portion 10*a* of cam bolt 10. On the other hand, outer race 37*b* of small-diameter ball bearing 37 is press-fitted into an inner peripheral surface of large-diameter portion 13*a* of motor output shaft 13 on the side of step portion 13*c*, and held in contact with an inner peripheral step surface of large-diameter portion 13*a*. Thus, small-diameter ball bearing 37 is held in place in an axial direction thereof.

Needle bearing 38 includes cylindrical retainer 38*a* press-fitted into an inner peripheral surface of eccentric shaft portion 39, and a plurality of needle rollers 38*b* rotatably supported in retainer 38*a*. One axial end (i.e., a front end) of retainer 38*a* is contacted with an axial end surface (i.e., a rear surface) of outer race 37*b* of small-diameter ball bearing 37. Needle rollers 38*b* are rollable on the outer peripheral surface of cylindrical portion 9*b* of follower member 9.

Small-diameter oil seal 46 is disposed between an outer peripheral surface of motor output shaft 13 (eccentric shaft portion 39) and an inner peripheral surface of extension wall 5*d* of motor housing 5. Small-diameter oil seal 46 serves to prevent lubricating oil from leaking from an inside of roller speed reducing mechanism 8 into electric motor 12.

The control unit is configured to determine a current operating condition of the engine on the basis of an information signal outputted from various sensors (not shown) such as a crank angle sensor, an air flow meter, an engine coolant temperature sensor, an accelerator position sensor, etc., and control the engine. The control unit is also configured to control rotation of motor output shaft 13 by outputting a control current to coil 18 through connector terminals 31*b*, second brushes 30*a*, 30*b*.

As shown in FIG. 1 and FIG. 2, roller speed reducing mechanism 8 includes eccentric shaft portion 39 carrying out eccentric rotation, intermediate-diameter ball bearing 47 disposed on an outer periphery of eccentric shaft portion 39, rollers 48 disposed on an outer periphery of intermediate-diameter ball bearing 47, cage 41 that retains rollers 48 so as to roll on the outer periphery of intermediate-diameter ball bearing 47 and permits radial displacement of rollers 48, and follower member 9 integrally formed with cage 41.

Figure 6:
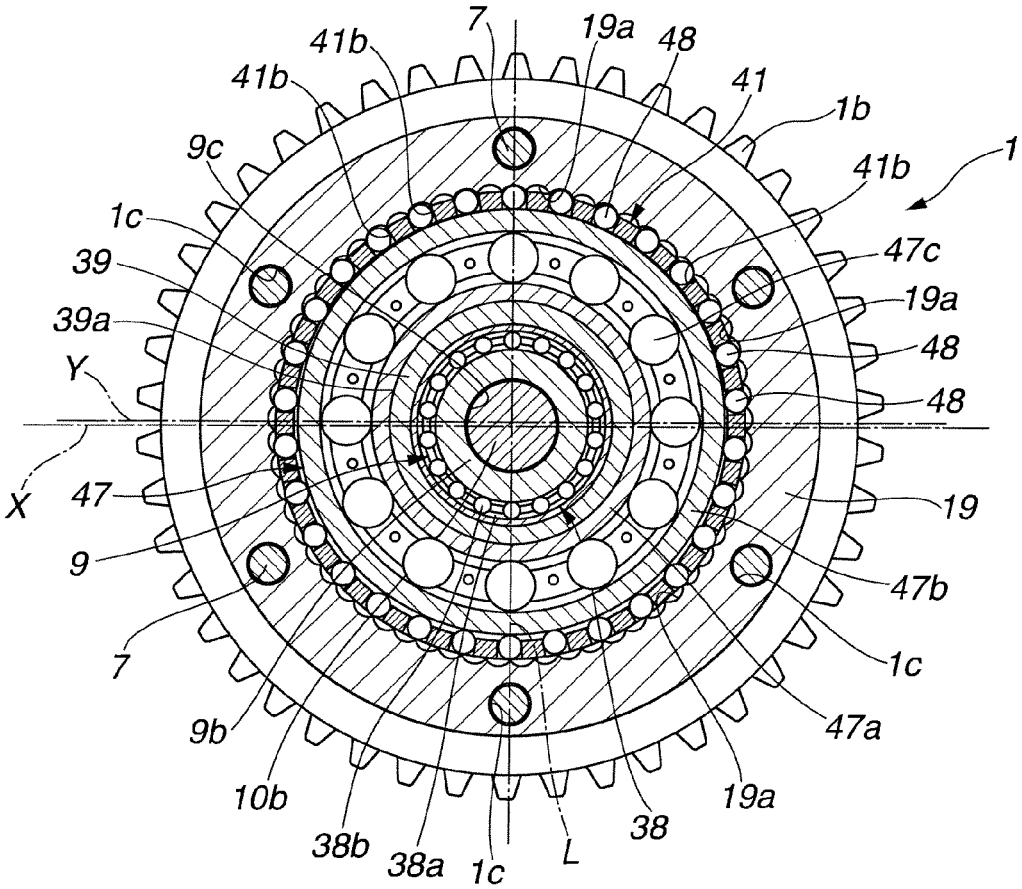
FIG. 6 is a cross-section of the variable valve operating apparatus according to the first embodiment of the present invention, taken along line A-A as shown in FIG. 1.

Eccentric shaft portion 39 is formed into a cylindrical sleeve shape, and integrally connected to large-diameter portion 13*a* of motor output shaft 13 at a front end thereof. As shown in FIG. 6, eccentric shaft portion 39 has cam surface 39*a* on an outer peripheral surface thereof. Central axis Y of eccentric shaft portion 39 is slightly offset relative to central axis X of motor output shaft 13 in a radial direction of motor output shaft 13.

Intermediate-diameter ball bearing 47 is disposed in such a state that intermediate-diameter ball bearing 47 as a whole is substantially overlapped with needle bearing 38 in a radial direction thereof. Intermediate-diameter ball bearing 47 includes inner race 47*a*, outer race 47*b* and balls 47*c* disposed between inner and outer races 47*a*, 47*b*. Inner race 47*a* is press-fitted onto cam surface 39*a* of eccentric shaft portion 39. On the other hand, outer race 47*b* is held free without being restrained in an axial direction thereof. That is, one axial end surface of outer race 47*b* on the side of electric motor 12 is out of contact with any other component, and the other axial end surface thereof is opposed to the bottom wall of cage 41 with a fine clearance therebetween.

An outer peripheral surface of outer race 47*b* is rollably contacted with an outer peripheral surface of each of rollers 48, and is opposed to an inner peripheral surface of side wall 41*a* of cage 41 with annular clearance C1 therebetween as shown in FIG. 1. With the provision of clearance C1, as eccentric shaft portion 39 is rotated, intermediate-diameter ball bearing 47 as a whole can be moved in a radial direction thereof, that is, intermediate-diameter ball bearing 47 can be eccentrically moved.

Rollers 48 are formed of an iron-based material. As intermediate-diameter ball bearing 47 is eccentrically moved, respective rollers 48 are moved in a radial direction of intermediate-diameter ball bearing 47 and brought into engagement with internal teeth 19*a* of internal gear member 19. Respective rollers 48 are also guided by both side edges of respective roller retaining holes 41*b* of cage 41 in a circumferential direction of intermediate-diameter ball bearing 47 and swingably moved in the radial direction thereof.

Roller speed reducing mechanism 8 is supplied with lubricating oil through a lubricating oil supply path. The lubricating oil supply path is formed in a bearing of the cylinder head. The lubricating oil supply path includes an oil supply passage through which the lubricating oil is supplied from a main oil gallery (not shown), oil supply hole 51 extending in camshaft 2 in the axial direction of camshaft 2 and communicated with the oil supply passage through a groove, and small-diameter oil hole 52 extending through follower member 9 in the axial direction of follower member 9 as shown in FIG. 1. Oil hole 52 has one end opened to oil supply hole 51 through annular passage 51*a* and the other end opened to the vicinity of needle bearing 38 and intermediate-diameter ball bearing 47.

With the provision of the lubricating oil supply path, the lubricating oil is supplied to and stored in clearance 44 between side wall 41*a* of cage 41 and partition wall 5*b* of housing body 5*a*, and then supplied to intermediate-diameter ball bearing 47 and respective rollers 48 and lubricates these parts. The lubricating oil then is flowed into eccentric shaft portion 39 and motor output shaft 13 and lubricates moveable parts such as needle bearing 38 and small-diameter ball bearing 37. The lubricating oil stored in clearance 44 is prevented from leaking into motor housing 5 by small-diameter oil seal 46.

As shown in FIG. 1, one side portion of coil 18 is located opposed to and close to front end surface 5*e* in the concave portion of partition wall 5*b*. That is, coil 18 is arranged in such a state that one side portion of coil 18 is fitted into the concave portion of partition wall 5*b* through extension wall 5*d*.

Housing body 5*a* includes stepped convex portion 5*f* projecting forwardly (i.e., toward permanent magnets 14, 15) on a side of a front end of housing body 5*a*. Stepped convex portion 5*f* having an annular shape is formed between partition wall 5*b* and an outer periphery of housing body 5*a*. Stepped convex portion 5*f* is integrally connected with partition wall 5*b* on a rear side thereof. Stepped convex portion 5*f* has an inner diameter smaller than that of housing body 5*a*.

Further, stepped convex portion 5*f* has one axial end surface (i.e., front end surface) 5*g* opposed to one axial end (i.e., rear end surface) 14*a*, 15*a* of each of permanent magnets 14, 15. As shown in FIG. 1, a gap between one axial end surface 5*g* and one axial end 14*a*, 15*a* of each of permanent magnets 14, 15 are determined so as to cause no influence on a flow of the magnetic flux of each of permanent magnets 14, 15.

Figure 3:
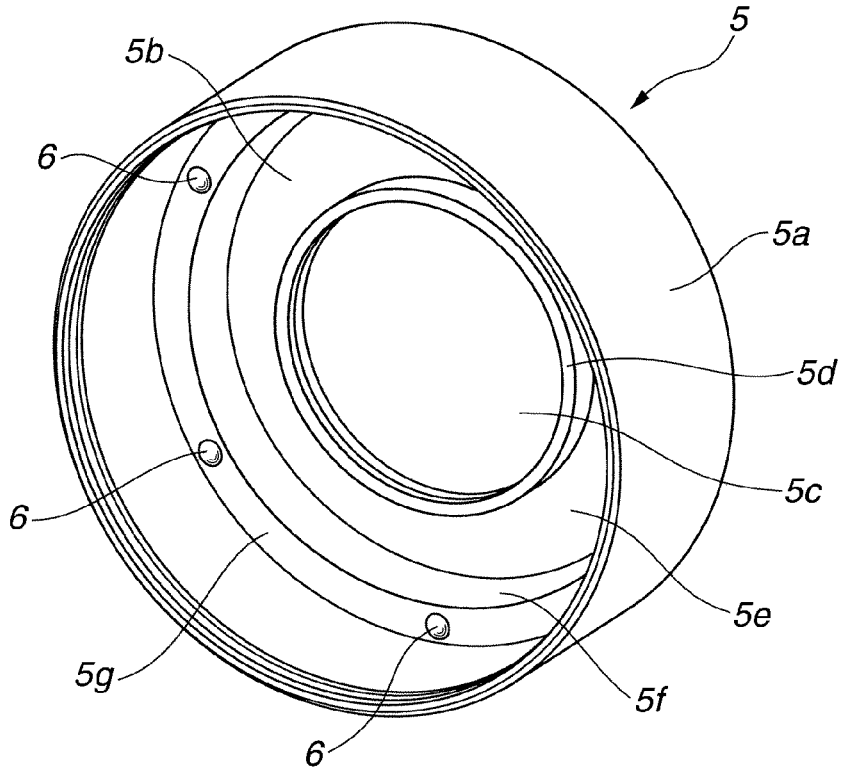
FIG. 3 is a perspective view of a motor housing of the variable valve operating apparatus of the first embodiment.
Figure 4:
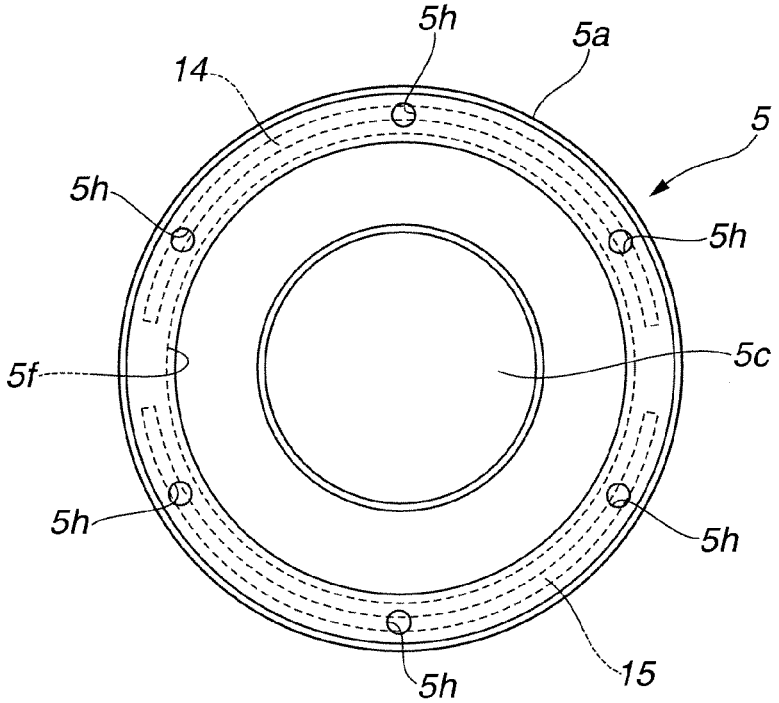
FIG. 4 is a rear view of the motor housing shown in FIG. 3.

Further, as shown in FIG. 1, FIG. 3 and FIG. 4, six threaded holes 5*h* are formed in stepped convex portion 5*f*. Threaded holes 5*h* extend from a rear end of housing body 5*a* (i.e., on a side of sprocket body 1*a*) toward a front side of housing body 5*a* along an axial direction of motor housing 5, and terminate before front end surface 5*g* of stepped convex portion 5*f*. Threaded holes 5*h* are axially aligned with bolt insertion holes 1*c* of sprocket body 1*a* and bolt insertion holes 61*e* of retaining plate 61, and communicated therewith. Six bolts (fastening members) 7 are inserted into bolt insertion holes 1*c*, 61*e* and threaded holes 5*h*. As shown in FIG. 5, a tip end portion of each bolt 7 is screwed into each threaded hole 5*h*. Timing sprocket 1, retaining plate 61 and motor housing 5 are coupled and fastened to one another through bolts 7. As shown in FIG. 3 and FIG. 4, six projections 6 are formed at portions of front end surface 5*g* of stepped convex portion 5*f* which correspond to threaded holes 5*h*. Projections 6 are located in alignment with threaded holes 5*h* in an axial direction of threaded holes 5*h*, respectively. Each projection 6 projects from front end surface 5*g* of stepped convex portion 5*f* toward the front side of motor housing 5 in the axial direction of each threaded hole 5*h*. Each projection 6 has a closed end (a front end) in the axial direction such that the tip end portion of each bolt 7 is prevented from penetrating projection 6.

As shown in FIG. 5, each of projections 6 has an outer surface having a rounded convex shape, i.e., a part-spherical shape. Space (air space) S is formed between a tip end of each projection 6 and rear ends 14*a*, 15*a* of permanent magnets 14, 15. Space S has predetermined axial length $\alpha$ larger than radial length $\beta$ of air gap G formed between the outer peripheral surface of core rotor 17 and the inner peripheral surface of permanent magnets 14, 15.

[Operation of Variable Valve Operating Apparatus of Embodiment]

An operation of the variable valve operating apparatus according to this embodiment will be explained hereinafter. When the crankshaft of the engine is rotationally driven to rotate timing sprocket 1 through the timing chain, the rotation is transmitted to motor housing 5 through internal gear member 19 and partition wall 5*b* (respective projections 6), thereby causing synchronous rotation of electric motor 12. On the other hand, the rotation of internal gear member 19 is transmitted to camshaft 2 through respective rollers 48, cage 41 and follower member 9 so that the drive cams of camshaft 2 actuate the intake valves to be opened and closed.

When the engine is operated under a predetermined operating condition after the startup, the control unit outputs an exciting current to coil 18 of electric motor 12 through terminals 31, 31, pigtail harnesses 32*a*, 32*b*, second brushes 30*a*, 30*b* and slip rings 26*a*, 26*b*, so that motor output shaft 13 is rotationally driven. The rotation of motor output shaft 13 is inputted to roller speed reducing mechanism 8 in which a speed of the rotation is reduced. The reduced speed of the rotation is transmitted to camshaft 2.

Specifically, when eccentric shaft portion 39 is rotated with the rotation of motor output shaft 13, respective rollers 48 roll on internal teeth 19*a* of internal gear member 19 so as to move from one tooth of internal teeth 19*a* to the adjacent tooth of internal teeth 19*a* with rolling contact therewith, while being guided in roller retaining holes 41*b* of cage 41 in the radial direction of cage 41 per rotation of motor output shaft 13. Respective rollers 48 move in the circumferential direction of cage 41 while repeating such rolling movement. Owing to the rolling movement of rollers 48, the rotation of motor output shaft 13 is reduced, and the reduced rotation is transmitted to follower member 9. A speed reduction ratio at this time can be optionally set on the basis of the number of rollers 48.

As a result, camshaft 2 is rotated relative to timing sprocket 1 in a reverse direction to that of timing sprocket 1. Thus, a rotational phase of camshaft 2 relative to timing sprocket 1 is changed to thereby control the opening timing and the closing timing of the intake valves to a phase-advance side or a phase-retard side.

Camshaft 2 is controlled to the maximum rotational position (i.e., the maximum rotational phase position) relative to timing sprocket 1 by abutment of the side surfaces of stopper projection 61*b* of retaining plate 61 against one of opposed surfaces 2*c*, 2*d* of stopper engaging groove portion 2*b* of flange portion 2*a* of camshaft 2. With this construction, the opening and closing timings of the intake valves can be changed between the maximum phase-advance position and the maximum phase-retard position.

As explained above, in the variable valve operating apparatus according to this embodiment, projections 6 are formed only at portions on front end surface 5*g* of stepped convex portion 5*f* of housing body 5*a* which correspond to threaded holes 5*h*, respectively. That is, front end surface 5*g* is retarded toward sprocket body 1*a* except for projections 6 so that an axial length (i.e., a wall thickness) of stepped convex portion 5*f* along the axial direction of motor housing 5 is reduced, while a necessary axial length of threaded holes 5*h* is ensured. As a result, it is possible to reduce a substantially whole axial length of the variable valve operating apparatus and therefore serve to downsize the variable valve operating apparatus. In contrast, in a case where similarly to the above conventional art, the axial length of whole stepped convex portion 5*f* is increased in order to ensure the necessary axial length of threaded holes 5*h*, an excessive increase in axial length of the apparatus will be caused.

Further, owing to the reduction of the axial length of stepped convex portion 5*f*, one axial end surface 5*g* of stepped convex portion 5*f* is sufficiently spaced from one axial end 14*a*, 15*a* of each of permanent magnets 14, 15. Therefore, it is possible to suppress leakage of the magnetic flux generated between permanent magnets 14, 15 and core rotor 17 and housing body 5*a*, to the side of partition wall 5*b*.

As a result, it is possible to suppress reduction of magnetic efficiency of permanent magnets 14, 15 and therefore obtain a sufficient output torque of electric motor 12.

Further, predetermined axial length a of space S formed between the tip end of each projection 6 and rear ends 14*a*, 15*a* of permanent magnets 14, 15 is set to be larger than radial distance β of air gap G formed between the outer peripheral surface of core rotor 17 and the inner peripheral surface of permanent magnets 14, 15. With this construction, an amount of the magnetic flux passing through space S can be reduced to a large extent.

Further, there are provided only six projections 6 in total number. Therefore, even though the magnetic flux passes through space S, only a slight amount of the magnetic flux will pass through space S. Accordingly, it is possible to suppress reduction of magnetic efficiency of permanent magnets 14, 15.

Further, the outer surface of each projection 6 has the generally part-spherical shape. Therefore, as compared to the projection having a polygonal outer surface, an air flow generated upon rotation of core rotor 17 can be less disturbed.

Furthermore, stepped convex portion 5*f* can be simultaneously formed when housing body 5*a* is formed by forging. Accordingly, it is possible to perform a cost-saving effect and increase the strength of stepped convex portion 5*f*.

Second Embodiment

Figure 9:
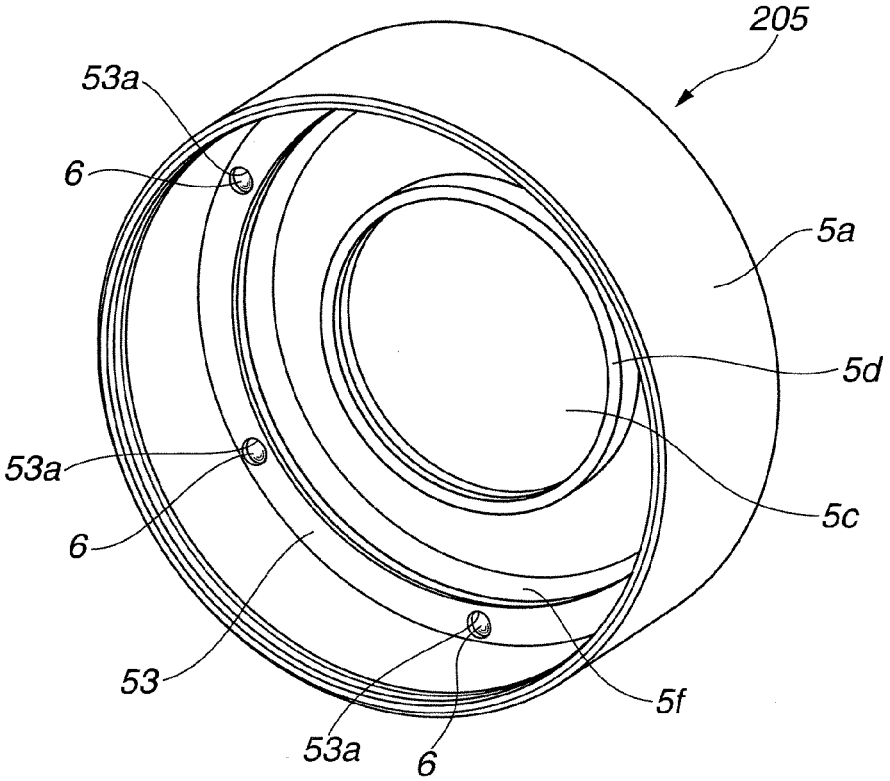
FIG. 9 is a perspective view of a motor housing of a variable valve operating apparatus according to a second embodiment of the present invention.
Figure 10:
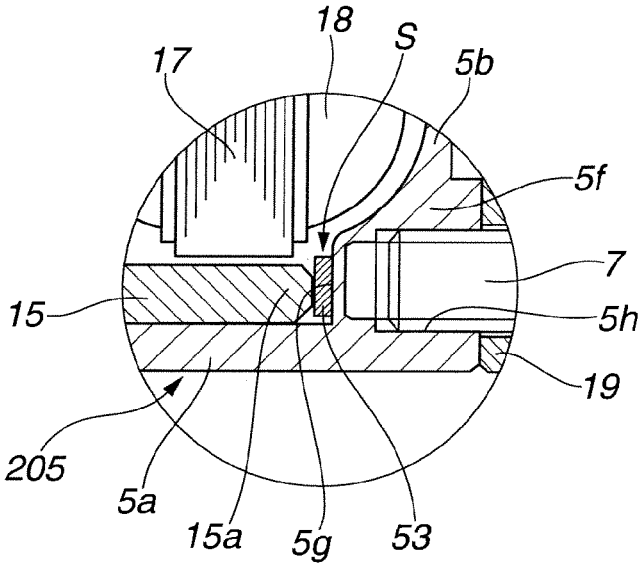
FIG. 10 is an enlarged cross-section of an essential part of a variable valve operating apparatus according to the second embodiment of the present invention.

FIG. 9 and FIG. 10 show motor housing 205 of the variable valve operating apparatus according to a second embodiment of the present invention. The second embodiment differs from the first embodiment in arrangement of non-magnetic member 53 in space S between the tip end of each projection 6 and rear ends 14*a*, 15*a* of permanent magnets 14, 15. Like reference numerals denote like parts, and therefore, detailed explanations therefor are omitted.

Non-magnetic member 53 having a low magnetic permeability may be made of a synthetic resin material. As shown in FIG. 9, non-magnetic member 53 is formed into an annular plate shape to cover front end surface 5*g* of stepped convex portion 5*f* of housing body 5*a*. Non-magnetic member 53 has six through holes 53*a* formed corresponding to projections 6. The tip end of each projection 6 is exposed through each through hole 53*a*.

Non-magnetic member 53 is previously fixed to front end surface 5*g* of stepped convex portion 5*f* by a suitable means, for instance, a bonding agent applied to front end surface 5*g* and the outer surface of each projection 6. Incidentally, the bonding agent at the tip end of each projection 6 exposed through each through hole 53*a* does not serve for bonding of non-magnetic member 53, but can perform an insulation effect.

Accordingly, in the variable valve operating apparatus according to the second embodiment, the magnetic flux extending from permanent magnets 14, 15 can be prevented from leaking to each projection 6 and partition wall 5*b* by non-magnetic member 53. As a result, it is possible to further suppress reduction of magnetic efficiency of permanent magnets 14, 15.

In the variable valve operating apparatus according to the second embodiment, through holes 53*a* are formed in non-magnetic member 53 corresponding to projections 6 in order to reduce the axial length of the variable valve operating apparatus. However, non-magnetic member 53 may be configured to cover projections 6 and the whole front end surface 5*g* of stepped convex portion 5*f* without forming through holes 53*a*.

Third Embodiment

Figure 11:
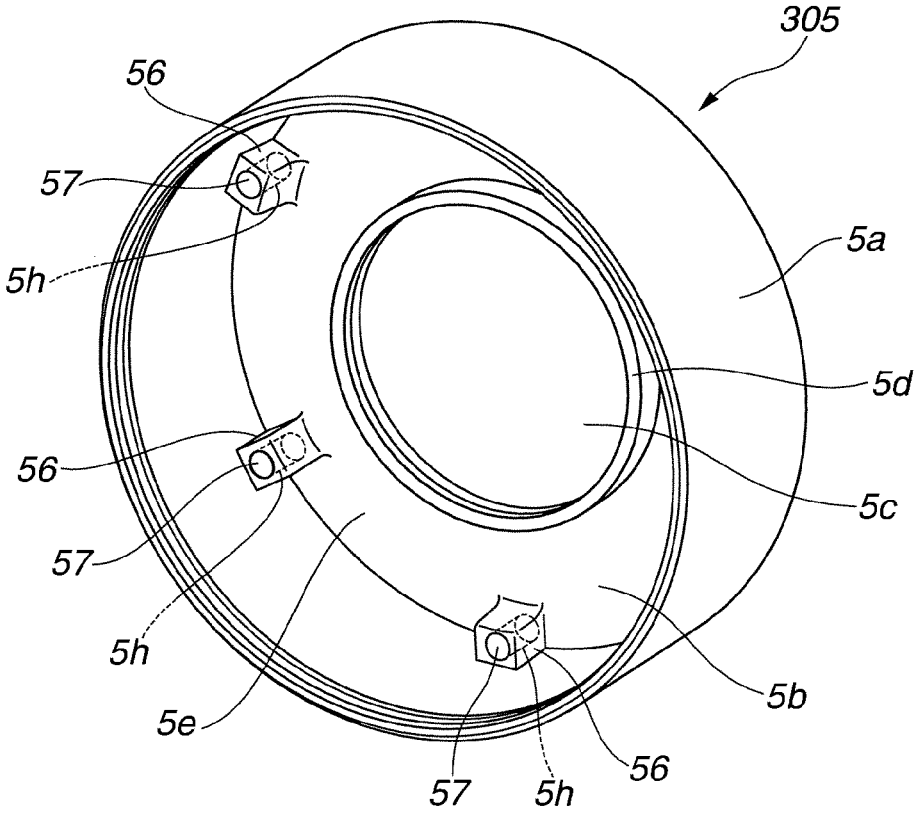
FIG. 11 is a perspective view of a motor housing of a variable valve operating apparatus according to a third embodiment of the present invention.

FIG. 11 shows motor housing 305 of the variable valve operating apparatus according to a third embodiment of the present invention. The third embodiment differs from the first embodiment in that six convex portions 56 are formed on front end surface 5*e* of partition wall 5*b* instead of stepped convex portion 5*f* of the first embodiment. Like reference numerals denote like parts, and therefore, detailed explanations therefor are omitted. In FIG. 11, there are shown only three of six convex portions 56. As shown in FIG. 11, convex portions 56 are provided as screw bosses projecting from an outer peripheral portion of front end surface 5*e* of partition wall 5*b*. Convex portions 56 are integrally formed with partition wall 5*b*. Convex portions 56 are located corresponding to bolt insertion holes 1*c* of sprocket body 1*a* and bolt insertion holes 61*e* of retaining plate 61, and extend from front end surface 5*e* of partition wall 5*b* toward the front side of motor housing 5 along the axial direction of motor housing 5.

Each convex portion 56 has threaded hole 5*h* having a closed end. Threaded hole 5*h* extends from the rear end of housing body 5*a* (i.e., on the side of sprocket body 1*a*) toward the front side of motor housing 5 along the axial direction of motor housing 5. Threaded holes 5*h* are aligned with bolt insertion holes 1*c* of sprocket body 1*a* and bolt insertion holes 61*e* of retaining plate 61 and communicated therewith. Six bolts (fastening members) 7 are screwed into threaded holes 5*h* to couple and fasten timing sprocket 1, retaining plate 61 and motor housing 5 to one another.

Each convex portion 56 has projection 57 on a distal end surface (i.e., a front end surface) thereof which is located on a side of the closed end of each threaded hole 5*h*. Projection 57 has an outer surface formed into a generally part-spherical shape. Space (air space) S is formed between a tip end of each projection 57 and rear ends 14*a*, 15*a* of permanent magnets 14, 15. Space S has predetermined axial length α larger than radial length β of air gap G formed between the outer peripheral surface of core rotor 17 and the inner peripheral surface of permanent magnets 14, 15.

In the variable valve operating apparatus according to the third embodiment, front end surface 5*e* of partition wall 5*b* is located further spaced from rear ends 14*a*, 15*a* of permanent magnets 14, 15 than front end surface 5*g* of stepped convex portion 5*f* of the first embodiment. Therefore, it is possible to further suppress reduction of the magnetic efficiency of permanent magnets 14, 15.

Fourth Embodiment

Figure 12:
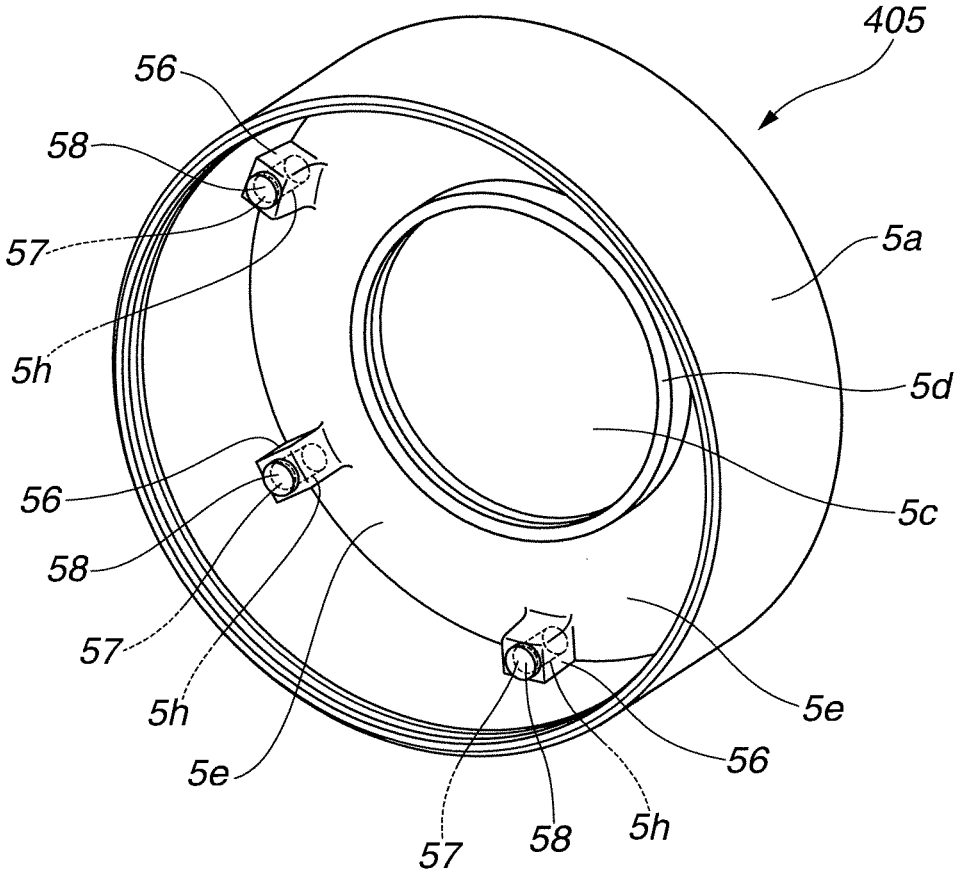
FIG. 12 is a perspective view of a motor housing of a variable valve operating apparatus according to a fourth embodiment of the present invention.

FIG. 12 shows motor housing 405 of the variable valve operating apparatus according to a fourth embodiment of the present invention which is a modification of the third embodiment. The fourth embodiment differs from the third embodiment in arrangement of non-magnetic member 58 in space S between a tip end of each projection 57 of each convex portion 56 and rear ends 14*a*, 15*a* of permanent magnets 14, 15. Like reference numerals denote like parts, and therefore, detailed explanations therefor are omitted.

Non-magnetic member 58 having a low magnetic permeability may be made of a synthetic resin material. As shown in FIG. 12, non-magnetic member 58 is formed into a disk shape to cover each projection 57 of each screw boss 56. Non-magnetic member 58 is previously fixed to an outer surface of each projection 57 by a suitable means, for instance, a bonding agent applied to each projection 57.

In the variable valve operating apparatus according to the fourth embodiment, the magnetic flux extending from permanent magnets 14, 15 can be prevented from leaking to each projection 57 and partition wall 5*b* by non-magnetic member 58. As a result, it is possible to further suppress reduction of the magnetic efficiency of permanent magnets 14, 15.

The present invention is not limited to the above embodiments, and may be variously modified. For instance, each permanent magnet as the first magnetic flux forming portion can be disposed on a side of the motor output shaft, and the coil wound on core rotor 17 as a second magnetic flux forming portion can be disposed on an inner peripheral side of the motor housing.

This application is based on a prior Japanese Patent Application No. 2013-128037 filed on Jun. 19, 2013. The entire contents of the Japanese Patent Application No. 2013-128037 are hereby incorporated by reference.

Although the invention has been described above by reference to certain embodiments of the invention and modifications of the embodiments, the invention is not limited to the embodiments and modifications described above. Further variations of the embodiments and modifications described above will occur to those skilled in the art in light of the above teachings. The scope of the invention is defined with reference to the following claims.

What is claimed is:

1. A variable valve operating apparatus for an internal combustion engine, comprising:

an electric motor comprising a motor housing having an accommodating space therein and being made of a magnetic material, at least one permanent magnet disposed on an inner peripheral surface of the motor housing, the permanent magnet having a plurality of magnetic poles along a circumferential direction thereof, a rotor disposed on an inner peripheral side of the permanent magnet so as to be rotatable relative to the permanent magnet, the rotor having a coil wound thereon to form a magnetic flux in a circumferential direction of the rotor upon being energized, and a brush and a commutator which cooperate with each other to carry out changeover between energization and non-energization of the coil; and a speed reducing mechanism configured to reduce a speed of rotation of the electric motor, the speed reducing mechanism comprising a casing, wherein the motor housing and the casing of the speed reducing mechanism are coupled to each other by means of a plurality of bolts inserted from a side of the casing of the speed reducing mechanism into the motor housing, wherein the motor housing comprises a convex portion formed in a portion of the motor housing which is opposed to one axial end of the permanent magnet, the convex portion having a threaded hole into which a tip end portion of each of the plurality of bolts is screwed, respectively, and a projection formed on an axial end surface of the convex portion in alignment with the threaded hole in an axial direction of the threaded hole, and wherein the axial end surface of the convex portion is located further spaced from the one axial end of the permanent magnet than the projection.

2. The variable valve operating apparatus as claimed in claim 1, wherein the projection is opposed to the one axial end of the permanent magnet with a space.

3. The variable valve operating apparatus as claimed in claim 2, wherein the space between the projection and the one axial end of the permanent magnet has an axial length larger than a radial length of an air gap between an outer peripheral surface of the rotor and an inner peripheral surface of the permanent magnet.

4. The variable valve operating apparatus as claimed in claim 1, wherein the projection has an outer surface having a rounded convex shape.

5. The variable valve operating apparatus as claimed in claim 1, wherein the projection has a closed end in an axial direction thereof such that the tip end portion of each of the plurality of bolts is prevented from penetrating the projection.

6. The variable valve operating apparatus as claimed in claim 1, wherein the motor housing further comprises a partition wall disposed on one axial end portion of the motor housing which is located on a side of the speed reducing mechanism, the partition wall being integrally formed with the projection, the partition wall serving to separate the electric motor and the speed reducing mechanism from each other.

7. The variable valve operating apparatus as claimed in claim 6, wherein the partition wall comprises a concave portion recessed toward the speed reducing mechanism, a part of the coil being located close to the concave portion of the partition wall.

8. The variable valve operating apparatus as claimed in claim 7, wherein the coil is arranged in such a state that the part of the coil is fitted into the concave portion of the partition wall.

9. The variable valve operating apparatus as claimed in claim 8, wherein the partition wall has a shaft insertion hole at a central portion thereof which receives a motor output shaft through which rotation of the rotor is transmitted to the speed reducing mechanism, and a seal member is disposed between the partition wall and the motor output shaft, the seal member serving to prevent a lubricating oil for lubricating parts of the speed reducing mechanism from flowing into the motor housing.

10. The variable valve operating apparatus as claimed in claim 1, wherein the variable valve operating apparatus is used for a rotational phase adjusting mechanism configured to adjust a valve timing of an engine valve by transmitting a reduced speed of rotation of the electric motor which is reduced by the speed reducing mechanism to a camshaft, the variable valve operating apparatus further comprising a slip ring and a second brush moveable while being contacted with the slip ring, the electric motor being energized through the slip ring and the second brush.

11. A variable valve operating apparatus for an internal combustion engine, comprising:

an electric motor comprising a motor housing having an accommodating space therein and being made of a magnetic material, at least one permanent magnet disposed on an inner peripheral surface of the motor housing, the permanent magnet having a plurality of magnetic poles along a circumferential direction thereof, a rotor disposed on an inner peripheral side of the permanent magnet so as to be rotatable relative to the permanent magnet, the rotor having a coil wound thereon to form a magnetic flux in a circumferential direction of the rotor upon being energized, and a brush and a commutator which cooperate with each other to carry out changeover between energization and non-energization of the coil; and a speed reducing mechanism configured to reduce a speed of rotation of the electric motor, the speed reducing mechanism comprising a casing, wherein the motor housing and the casing of the speed reducing mechanism are coupled to each other by means of a plurality of fastening members inserted from a side of the casing of the speed reducing mechanism into the motor housing, wherein the motor housing comprises a plurality of fastening member insertion portions into which the plurality of fastening members are inserted, respectively, the plurality of fastening member insertion portions being formed along a circumferential direction of the motor housing and opposed to one axial end of the permanent magnet, and wherein low permeable portions each having a permeability lower than a permeability of each of the plurality of fastening member insertion portions are provided on a side of an axial end of each of the plurality of fastening member insertion portions.

12. The variable valve operating apparatus as claimed in claim 11, wherein each of the low permeable portions is an air space between the axial end of each of the plurality of fastening member insertion portions and the one axial end of the permanent magnet.

13. The variable valve operating apparatus as claimed in claim 11, wherein each of the low permeable portions is a non-magnetic member.

14. The variable valve operating apparatus as claimed in claim 13, wherein the non-magnetic member is disposed on an axial end surface of each of the plurality of fastening member insertion portions.

15. A variable valve operating apparatus for an internal combustion engine, comprising:

an electric motor comprising a motor housing having an accommodating space therein and being made of a magnetic material, a first magnetic flux forming portion disposed on an inner peripheral surface of the motor housing, the first magnetic flux forming portion having a plurality of magnetic poles along a circumferential direction thereof, a second magnetic flux forming portion disposed on an inner peripheral side of the first magnetic flux forming portion so as to be rotatable relative to the permanent magnet, the second magnetic flux forming portion being configured to form a magnetic flux in a circumferential direction thereof upon being energized; and a speed reducing mechanism configured to reduce a speed of rotation of the electric motor, the speed reducing mechanism comprising a casing, wherein the motor housing and the casing of the speed reducing mechanism are coupled to each other by means of a plurality of fastening members inserted from a side of the casing of the speed reducing mechanism into the motor housing, wherein the motor housing comprises a plurality of fastening member insertion portions into which the plurality of fastening members are inserted, respectively, the plurality of fastening member insertion portions being formed along a circumferential direction of the motor housing and opposed to one axial end of the first magnetic flux forming portion, and wherein an air space or a non-magnetic member is provided at least between an axial end surface of each of the plurality of fastening member insertion portions and the one axial end of the first magnetic flux forming portion.

* * * * *